US005588911A

United States Patent [19]

Gomez

[11] Patent Number: 5,588,911

[45] Date of Patent: Dec. 31, 1996

[54] MECHANICAL CONTROL FOR CENTRAL AIR CONDITIONERS' OUTLETS

[75] Inventor: Reynaldo Gomez, Miami, Fla.

[73] Assignee: AC Directional Control, Inc., Miami, Fla.

[21] Appl. No.: 540,698

[22] Filed: Oct. 11, 1995

[51] Int. Cl.[6] ..... F24F 13/075

[52] U.S. Cl. ..... 454/290; 454/315; 454/325

[58] Field of Search ..... 454/284, 289, 454/290, 315, 318, 319, 320, 325

[56] References Cited

U.S. PATENT DOCUMENTS

| | | | |
|---|---|---|---|
| 1,424,410 | 8/1922 | Hopewell | 454/319 X |
| 2,065,328 | 12/1936 | Hadley . | |
| 3,388,655 | 6/1968 | Dennis et al. | 454/315 |
| 3,507,354 | 4/1970 | Dieckmann et al. | 454/284 X |
| 4,093,119 | 6/1978 | Swisher | 454/159 X |

FOREIGN PATENT DOCUMENTS

| | | | |
|---|---|---|---|
| 663772 | 8/1929 | France | 454/319 |
| 697781 | 1/1931 | France | 454/319 |
| 824055 | 2/1938 | France | 454/334 |
| 507427 | 9/1930 | Germany | 454/319 |
| 27774 | 3/1903 | Switzerland | 454/319 |
| 266962 | 3/1927 | United Kingdom | 454/286 |
| 504639 | 4/1939 | United Kingdom | 454/319 |

*Primary Examiner*—Harold Joyce
*Attorney, Agent, or Firm*—J. Sanchelima

[57] ABSTRACT

A mechanical control device for the air flowing through air conditioning outlets. A control assembly with a lever that can be adjusted in two or more predetermined positions for different settings of air flow direction and volume. The lever lodges in two or more respective bays in a plate that locks the lever firmly in one of the preselected positions. The control assembly is mounted typically at a readily accessible position on a wall. A shielded cable assembly is controlled by the control assembly at one end and the other end is connected to the adjustable fins found in conventional air conditioning outlets. The shielded cable is hidden and routed from the wall mounted control assembly to the outlet protruding from the ceiling. The fins are commonly connected and spring biased to a preset position.

4 Claims, 1 Drawing Sheet

MECHANICAL CONTROL FOR CENTRAL AIR CONDITIONERS' OUTLETS

BACKGROUND OF THE INVENTION

1. Field of the Invention.

The present invention relates to controls for air conditioners' outlets.

2. Description of the Related Art.

Several controls have been designed in the past for the control of the air flow through the outlets of the central air conditioner systems. Most of these devices include a number of complicated parts that not unusually end up failing or making the device more expensive. A simple and effective solution, such as the one disclosed here, permits a user to reliably control the air flow through the outlets of an air conditioner system thereby distributing the air flow on different areas of the dwelling, as required.

However, applicant believes that the closest reference corresponds to U.S. Pat. No. 2,065,328 issued to Harold F. Hadley in 1935. Hadley's patent discloses a remote control button with a flexible cable causing the deflector assembly to be rotated about a pin, to a desired position for directing the air flow. Handley's mechanism is susceptible to being affected by slight accidental touching. On the other hand, the present invention discloses a remote control assembly with a flexible cable for controlling the different angles of several fins of an outlet assembly, including a position for completely closing the outlet to any air flow. A desired direction and volume of air flow results. The present invention claims spring members and a locking mechanism that permit a rapid, firm, and more efficient mechanism of the control assembly.

SUMMARY OF THE INVENTION

It is one of the main objects of the present invention to provide a device for controlling the direction and volume of the air flow through the outlets of a central air conditioner system.

It is another object of this invention to provide such a device that is reliable with a minimum number of parts. Also, it is an object of this invention to provide a mechanism where the direction and volume of air flow can be reliably set.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
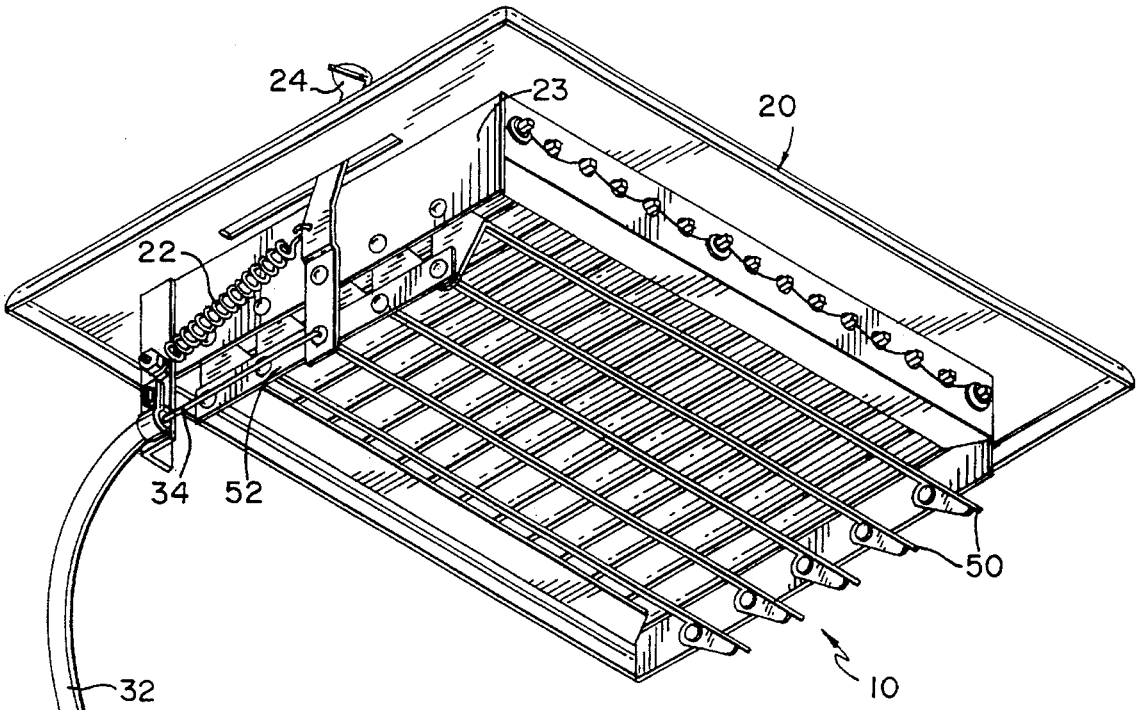
FIG. 1 represents a preferred embodiment of the present invention wherein a typical outlet is shown connected through a shielded cable that is mechanically connected to a control assembly.

Referring now to the drawings, where the present invention is generally referred to with numeral 10 in FIG. 1, it can be observed that it basically includes outlet assembly 20, as typically used in air conditioning systems, and shielded cable assembly 30, such as the one used in the hand brakes of bicycles, or the like. Control lever 40 is mechanically connected at one end of cable 30 and the other end is connected to fins 50 that are pivotally mounted to outlet assembly 20. A user can then move control lever assembly 40 and this movement is transmitted through cable 30 to fins 50, thereby controlling the amount of air that flows through outlet assembly 20.

Outlet assembly 20, as any conventional air conditioners' outlets, includes fins 50 to let the air flows into the rooms and lever 24 mounted to the fins for a user to manually control the air flow. Outlet assembly 20, in the preferred embodiment, includes fins 50 pivotally mounted to plate member 23 that is in turn rigidly mounted to outlet assembly 20. Fins 50 are commonly connected for in tandem movement through linkage arm 52. A user actuates lever member 24 from control lever assembly 40 through shielded cable assembly 30. As shown in FIG. 1, lever members 24 and 44 are connected by inner cable 34 which is shielded by outer tubular casing 32.

Figure 2:
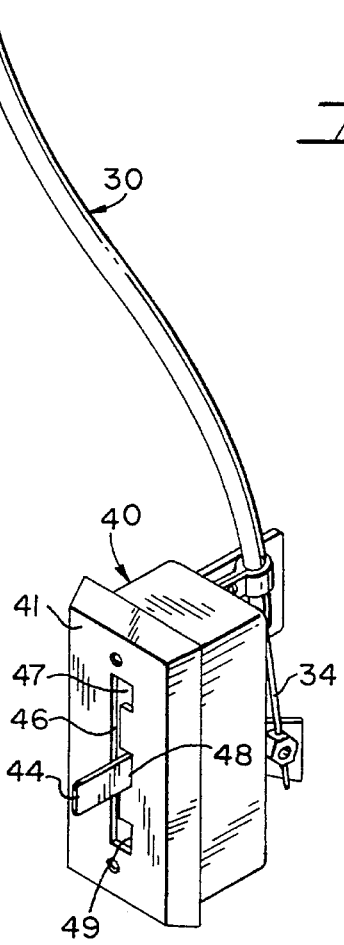
FIG. 2 is a rear view of the control lever assembly used in the present invention.
Figure 2:
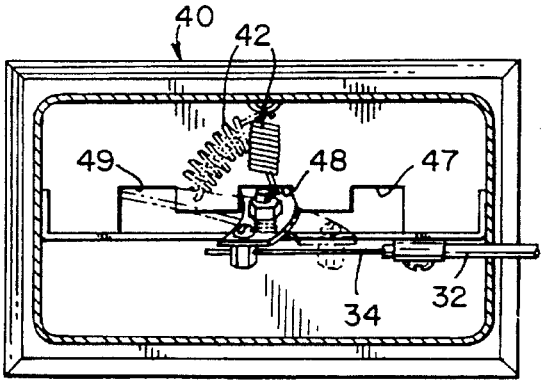

Spring 22 biases lever 24 causing fins 50 to be in the closed position (not shown in the drawing). Control lever assembly 40, in the preferred embodiment, has front plate 41 with slot 46 and bays 47; 48 and 49, as best seen in FIG. 1. Control lever 44 of control lever assembly 40 is preferably designed to lock in one of three preselected positions. Spring 42 urges lever 44 against the bay side of slot 46 causing the former to securely lodge itself in one of the three bays 47; 48 or 49, as seen in FIGS. 1 and 2. Bay 47 corresponds to the open position (permits the maximum air flow through outlet assembly 20), bay 48 partially closes fins 50 and bay 49 prevents most of the airflow through. The order for open and close positions for lever 44 in bays 47; 48 or 49 will vary with the design of assembly 20. In other words, depending on the side of assembly 20 where spring 22 is mounted, bays 47 and 49 will represent the open position or the close position of fins 50 and viceversa.

Cable assembly 30 can be embedded inside the wall, and typically below the sheet rock, to hide it. Control lever assembly 40 is mounted in a convenient position to provide ready access to the user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mechanical control for the air flowing through air conditioner's outlet, comprising:

a) control means having a first lever that can be positioned in at least two positions;

b) shielded cable means including an internal cable and an outer shield having each first and second ends, said internal cable is slidably housed by said outer shield, and the first end of said internal cable being connected to said first lever so that said internal cable moves in response to the actuation of said first lever; and c) outlet means having a plurality of fins pivotally mounted to said outlet and linking arm means commonly connected to said plurality of fins, a second lever that actuates said fins, said second lever being pivotally mounted to said outlet and being connected to said second end of said internal cable so that the movement of said first lever is transmitted through said internal cable causes said second lever to move to a corresponding predetermined position.

2. The mechanical control set forth in claim 1 wherein said outlet means further includes first spring means for biasing said fins in a predetermined position.

3. The mechanical control set forth in claim 2 wherein said control means includes a front plate through which said first lever protrudes, said front plate includes a slot and at least two bays wherein said first lever selectively lodges when in one of said positions.

4. The mechanical control set forth in claim 3 wherein said control means includes second spring means for biasing said first lever against said bays thereby ensuring a firm lodging of said first lever in one of said bays.

* * * * *